US006406751B1

(12) United States Patent
Daniels

(10) Patent No.: US 6,406,751 B1
(45) **Date of Patent: *Jun. 18, 2002**

(54) APPARATUS AND A PROCESS FOR PREVENTING STALAGMITE FORMATION IN THE PAPER COATING OPERATION

(75) Inventor: Jos Valentin Florent Daniels, Meeuwen-Gruitrode (NL)

(73) Assignee: KNP Papier B.V., Maastricht (NL)

( * ) Notice: Subject to any disclaimer, the term of this patent is extended or adjusted under 35 U.S.C. 154(b) by 0 days.

This patent is subject to a terminal disclaimer.

(21) Appl. No.: 08/034,532

(22) Filed: Mar. 19, 1993

Related U.S. Application Data

(63) Continuation of application No. 07/711,636, filed on Jun. 6, 1991, now Pat. No. 5,219,618.

(30) Foreign Application Priority Data

Jun. 8, 1990 (NL) ..... 9001303

(51) Int. Cl.[7] ..... B05D 3/12

(52) U.S. Cl. ..... 427/356; 15/256.51; 118/104; 118/126; 118/261

(58) Field of Search ..... 427/356; 118/261, 118/104, 126; 15/256.51

(56) References Cited

U.S. PATENT DOCUMENTS

| | | | | | |
|---|---|---|---|---|---|
| 3,152,918 | A | * | 10/1964 | Kraus | 117/63 |
| 3,166,464 | A | * | 1/1965 | Eolkin | 15/256.51 |
| 3,658,003 | A | * | 4/1972 | Johnson | 101/426 |
| 3,701,335 | A | * | 10/1972 | Barnscheidt | 118/104 |
| 3,952,650 | A | * | 4/1976 | Lotte | 101/120 |
| 5,219,618 | A | * | 6/1993 | Daniels | 427/356 |

* cited by examiner

*Primary Examiner*—Katherine A. Bareford
(74) *Attorney, Agent, or Firm*—Robert D. Katz; Copper & Dunham LLP

(57) ABSTRACT

In the paper coating operation a wet or dry edge from coating composition is formed on the, seen in the direction of movement of the paper web, downstream side of the doctor, the so-called stalagmite formation. This stalagmite formation leads to various problems in the papermaking process and especially occurs at high speeds of the paper web and/or a high solids content of the coating composition, which two operating conditions are exactly required to obtain a maximum paper yield and a high paper quality. According to the invention the stalagmite formation is effectively prevented by supplying a fluid inhibiting the stalagmite formation to an area bounded, on the one hand, by the paper web and, on the other hand, by the above side of the doctor blade.

2 Claims, 1 Drawing Sheet

APPARATUS AND A PROCESS FOR PREVENTING STALAGMITE FORMATION IN THE PAPER COATING OPERATION

This is a continuation of application Ser. No. 67/711,636, filed Jun. 6, 1991.

This invention relates to an apparatus and a process for preventing stalagmite formation in the paper coating operation.

In the manufacture of coated paper, to obtain paper having a smoother and microporous surface, one or more coatings serving to fill in the roughnesses in the paper surface and thereby to equalize that surface are applied to the uncoated paper. Suitably, an excess of wet coating composition is applied to the paper web by means of a premetering device.

In order to provide a uniform thickness of the coating on the paper web, a doctor, the so-called doctor blade, extending across the width of the paper web is arranged at some distance from the premetering device.

It has been known for many years that at high speeds of a paper web, which high speeds are desired to realize the highest possible production, problems arise in the area downstream of the doctor blade, seen in the direction of travel of the paper web, (the so-called "dry" side of the doctor blade) owing to the fact that in that area, across the length of the doctor blade, a liquid or hard edge is formed consisting of coating composition which may or may not be mixed with fibres. In the technical literature the formation of such an edge is called "stalagmite formation" or also "bleeding", "whiskering" or "feathering". In the present text the term stalagmite formation will be used.

It is known from the literature that the stalagmite formation assumes more serious proportions as the speed of the paper web increases. At the moment speeds of 1,000 to 1,500 m/min are already customary and for the future even higher speeds are not impossible. Moreover, the gravity of stalagmite formation depends on the composition of the coating, for which every paper maker has his own specific recipe, which coating, however, will always contain a pigment constituent, such as clay or chalk, and a binder, such as a latex or a modified starch. It is desirable both for the quality of the paper and for the production costs thereof to apply a coating having a high solids content. Such a high solids content, however, is also found to promote a strong stalagmite formation at the doctor blade.

The formation of a stalagmite on the "dry" side of the doctor blade is highly undesirable, because pieces of coating composition may get loose from this stalagmite, especially when it assumes too large sizes, which pieces, when arriving at the paper web, may damage the paper surface, as they cause streaks and cavities. Furthermore, hard pieces of stalagmite may damage the surface of the rolls over which, in the process of papermaking, the paper web passes after application of the coating. In particular the surface of the so-called calender rolls to be used for the further smoothing of the paper surface is susceptible to this. Replacement of such rolls is very expensive. Finally, in the subsequent process of printing paper hard pieces of coating composition which are still present in the paper after the manufacturing process may lead to problems or to disfigured printed matter. In addition, the occurrence of stalagmite restricts the selection of the raw materials to be used in the coating composition, which may adversely affect the quality of the paper and/or the costs of raw materials.

For a more detailed description of the problem described above, reference can be made to three articles in the "Wochenblatt fur Papierfabrikation", namely "Streichfarben mit hohem Feststoffgehalt—Rheologie und Verarbeitbarkeit beim Bladestreichen" by G. Engström in Vol. 6, 1984, pages 184–187; "Fabrikationsstörungen durch stalagmitenf örmigen Streichfarbenaufbau an den Schabern schnell laufender Streichmaschinen" by H. P. Hofmann and A. von Raven in Vol. 8, 1986, pages 261–265; and "Betrachtungen über Stalagmitenbildung und Bladeüberkochen" by D. Eklund and S. Fors in Vol. 10, 1988, pages 400–404. Two articles published in "Tappi" in 1973 show that the disadvantageous effects of stalagmite formation have been recognized for may years. These articles are: "Effect of coating color rheology on the blade coating process" by J. P. Modrak in Vol. 56, No. 10, October 1973, pages 70–73 and "Effect of hydrocoloids on coating color operability and coating paper properties" by E. J. Barbar in Vol. 56, No. 10, January 1973, pages 52–55.

It will be clear from the above that in the paper coating operation it is highly important to prevent stalagmite formation without concessions being required with regard to the desired high speed of the paper web and/or the makeup of the coating composition and/or the properties of the paper to be coated and more in particular with concessions being required with regard to the desired relatively high solids content of the coating composition.

It is therefore an object of the invention to provide an apparatus and a process for fully inhibiting stalagmite formation or at least reducing stalagmite formation to an absolutely harmless level, independently of the speed of the paper web moving along the doctor, independently of the makeup and the solids content of the coating composition and independently of the quality of the paper to be coated.

The invention suitably provides a process for coating paper, which comprises providing a paper web with a layer of coating composition and passing the paper web along a doctor, characterized in that harmful stalagmite formation on the, seen in the direction of movement of the paper web, downstream side of the doctor is prevented by supplying a fluid inhibiting stalagmite formation to an area which, on the one hand, is bounded by the paper web and, on the other hand, by the above side of the doctor.

The fluid inhibiting stalagmite formation is preferably steam, but also applicable is water or a mixture of steam and/or water and/or air and any other fluid that inhibits stalagmite formation and does not adversely affect the quality of the paper and/or the coating.

The invention also provides an apparatus for coating paper equipped with means for providing a paper web with a layer of coating composition and with a doctor extending across the width of the paper web, characterized in that means are provided for supplying in an evenly distributed manner a fluid inhibiting stalagmite formation across substantially the width of the, seen in the direction of travel of the paper web, downstream side of the doctor to an area bounded by the paper web and the above side of the doctor.

Surprisingly, it has been found that under conditions of practice stalagmite formation is prevented by the steps according to the invention without affecting the composition and/or the behavior of the coating composition in any manner whatsoever.

It is an additional advantage of the invention that the working life of a doctor blade considerably increases because this blade need no longer be replaced as is customary when too much stalagmite has been formed, but since no stalagmite is formed anymore this blade needs to be replaced only when the edge of the blade is going to exhibit signs of wear that are inadmissible for other reasons.

Different types of doctors are known and although, for simplicity's sake, reference is always made in the present text to a doctor blade, it is emphasized that the invention is not restricted to the use of doctor blades only, but is applicable in all types of doctors extending across substantially the width of a paper web and exhibiting the problem of stalagmite formation.

It is further observed that U.S. Pat. No. 3,152,918 discloses that in the paper coating operation the properties of the coating composition are affected by supplying moisture to the area between the premetering device and the doctor blade through a pipe provided with sprayer orifices. This principle, however, is completely unsuitable when a coating composition having a high solids content is to be used with the doctor blade, while the problem of stalagmite formation is exactly greatest at such a high solids content.

BRIEF DESCRIPTION OF THE DRAWING

The invention will be further explained below by means of a practical example with reference to the accompanying drawing, in which the figure shows a perspective elevational view of a paper coating apparatus provided with the means according to the invention.

In the figure the numeral 1 designates a roll over the surface of which a paper web 2 is passed. The roll 1 rotates in the direction indicated in the figure by an arrow. In order to remove the excess of coating composition from the paper web and to equalize the layer of coating composition there is provided a doctor blade 3 which is supported by a block 4 designed to hold the doctor blade across its width in the desired adjustable position with respect to the roll 1. The apparatus hitherto described is generally known in the papermaking industry and therefore needs no further explanation.

Figure 1:
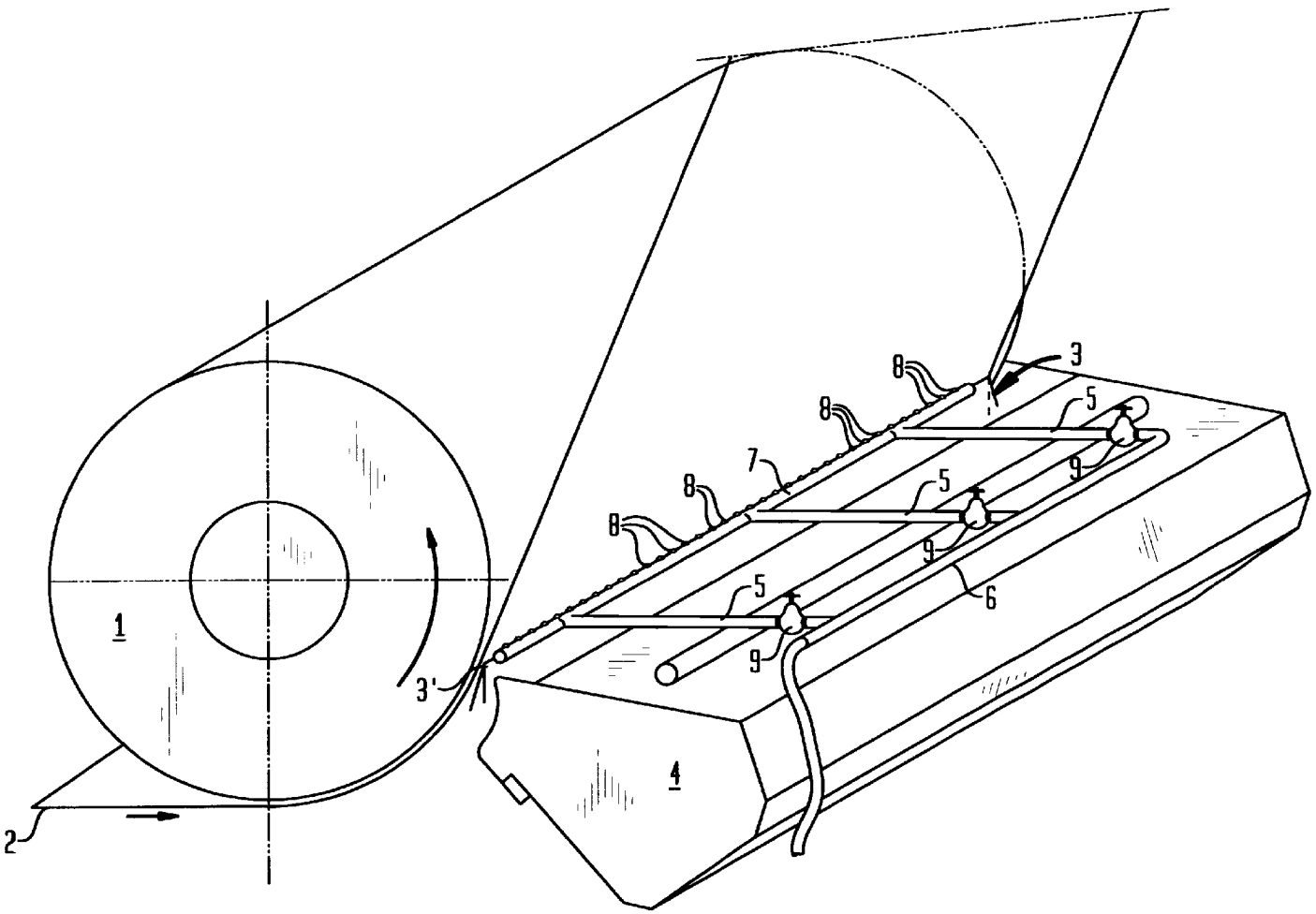

As described above, coating composition forming a wet or dry frayed edge, the stalagmite, collects at high speeds of the roll 1, and therefore of the paper web 2, and/or at a high solids content of the coating composition on the "dry" side of the doctor blade 3, which side is indicated in the figure by the numeral 3'.

According to the invention this stalagmite is prevented by providing a pipe system, which comprises three pipes 5, a common supply pipe 6 and a pipe 7 provided with equally spaced spray nozzles 8. The pipes 5 are connected on one side with the common supply pipe 6 by way of taps 9 and on the other side with a pipe 7. Through the pipes 6, 5 and 7 steam or water or a mixture thereof or another suitable fluid, in vapor or liquid form, can be supplied to the spray nozzles 8 at the area limited, on the one hand, by the "dry" side 3' of the doctor blade and, on the other hand, by the paper web 2. Instead of the spray nozzles 8, it is also possible to use one or more discharge openings that may or may not be in the form of slots.

The amount of fluid can be controlled by the taps 9, the preferred fluid being steam because its amount can be properly metered and because steam is abundant in the papermaking process. It has been found in practice that the exact position of the pipe 7 with respect to the doctor blade 3, the number and specific shape of the discharge opening(s) or spray nozzles 8 and the pressure at which the fluid is supplied can be freely selected within broad limits because as a result of the high speed of the paper web a reduced pressure is created near the "dry" side of the doctor blade so that, so to speak, the fluid is sucked to the "dry" side of the doctor blade and prevents the formation of the stalagmite.

Moreover, it will be clear to a worker skilled in the art that there are various obvious variants for the specific shape and number of the pipes 5, 6 and 7.

As appears from the above, the invention provides a very efficient, but also very inexpensively realized solution to a problem which, in the papermaking process, has been insurmountable and hitherto insolvable for many years.

I claim:

1. A process for smoothing a high solids coating on a moving paper web, comprising:

(a) transporting a paper web around a backing roller at a speed of at least 1000 m/min, the paper web having a first face contacting the roller and a second face for receiving a coating;

(b) providing an elongated doctor blade across the width of the roller such that the doctor blade smooths the coating applied to the paper web, the doctor blade having an elongated spraying apparatus mounted on one side thereof for spraying an aqueous liquid substantially across the width of the doctor blade;

(c) applying a high solids coating to the second face of the paper web;

(d) smoothing the higb solids coating with the doctor blade as the paper web moves past the roller; and (e) spraying an aqueous liquid toward the doctor blade on one side thereof adjacent the line defined by the intersection between the doctor blade and the paper web, while the paper web passes the doctor blade, such that liquid is sucked toward the line of contact between the doctor blade, against the direction of movement of the paper web, to prevent formation of stalagmites on the doctor blade without adversely affecting the coating on the moving paper web.

2. process in accordance with claim 1 wherein the aqueous liquid is water.

* * * * *

UNITED STATES PATENT AND TRADEMARK OFFICE

CERTIFICATE OF CORRECTION

PATENT NO. : 6,406,751 B1
DATED : June 18, 2002
INVENTOR(S) : Jos V.F. Daniels

It is certified that error appears in the above-identified patent and that said Letters Patent is hereby corrected as shown below:

Title page,
Item [73], delete Assignee "KNP Papier B.V." and insert -- KNP Leykam Services, B.V. --.
Item [74], delete "Copper" and insert -- Cooper --.

Signed and Sealed this

Eighteenth Day of February, 2003

JAMES E. ROGAN
*Director of the United States Patent and Trademark Office*